US005111964A

United States Patent [19]

Couper

[11] Patent Number: 5,111,964

[45] Date of Patent: May 12, 1992

[54] DEVICE FOR HOLDING ARTICLES AND PERMITTING THE REMOVAL THEREOF

[76] Inventor: John R. Couper, 533 E. Fourth #8, Loveland, Colo. 80537

[21] Appl. No.: 725,531

[22] Filed: Jul. 3, 1991

[51] Int. Cl.[5] ..... B65G 59/00

[52] U.S. Cl. ..... 221/111; 221/185; 221/283; 221/309; 221/310; 206/3

[58] Field of Search ..... 221/307, 308, 309, 310, 221/311, 312, 104, 107, 110, 111, 283, 185; 224/239, 252, 269; 206/3

[56] References Cited

U.S. PATENT DOCUMENTS

D. 207,905 6/1967 Couper .
689,053 12/1901 Anderson et al. ..... 221/309
892,391 7/1908 Blomquist ..... 221/309
2,122,003 6/1938 Cooper ..... 221/185
3,219,244 11/1965 Blask ..... 221/309
3,669,249 6/1972 Foster ..... 206/3

*Primary Examiner*—H. Grant Skaggs
*Attorney, Agent, or Firm*—Klass, Law, O'Meara & Malkin

[57] ABSTRACT

A device for holding a plurality of firearm cartridges having resilient portions to prevent movement, and therefore noise, of the firearm cartridges and having access openings to permit removal of a predetermined number of the firearm cartridges from a firearm cartridge removal section of the device and to permit the movement of the remaining firearm cartridges into the firearm cartridge removal section and wherein the resilient portions prevent movement, and therefore noise, of the remaining firearm cartridges.

20 Claims, 2 Drawing Sheets

DEVICE FOR HOLDING ARTICLES AND PERMITTING THE REMOVAL THEREOF

FIELD OF THE INVENTION

The invention relates generally to devices for holding articles so that they can be removed when desired and more particularly to devices for holding firearm cartridges so that they can be removed when desired.

BACKGROUND OF THE INVENTION

Many types of devices for carrying firearm cartridges and dispensing same while on one's person have been known and used previously. Some such means include leather or cloth pouches, vests, or garments with cartridge loops or pockets, belts with cartridge loops or pockets, and elastic material bands with cartridge loops or pockets which attach to the receiver or stock of a gun. At best, these devices can contain cartridges so they can be carried on one's person or attached to a firearm. However, they provide no means to protect the cartridges from dents, moisture or accidental discharge. Furthermore, in most cases, it is only practical to dispense one cartridge at a time by pulling each one out of a belt loop, pouch or pocket. This requires extra effort and time when reloading. Also, when carrying firearm cartridges in the field, such as when hunting, it is most desirable that they be carried in a noiseless manner.

BRIEF DESCRIPTION OF THE INVENTION

This invention provides devices for carrying articles, such as firearm cartridges, in a noiseless manner and permits removal of a predetermined number of such articles in one action and the movement of all or a portion of the remaining articles in the device into a location to be removed while maintaining the noiseless carrying of the remaining articles.

In the description of the preferred embodiments of the invention, the articles will be described as shotgun cartridges but it is understood that this is for descriptive purposes only and the invention is directed to devices for carrying any type of relatively rigid articles or firearm cartridges. In the preferred embodiments of the invention, the device comprises a hollow housing for holding a plurality of shotgun cartridges and is integrally molded using a relatively rigid material, such as a plastic material, such as a polycarbonate or other materials having similar characteristics or from metallic materials. Resilient means are provided on the hollow housing to prevent movement of the shotgun cartridges when in the housing so that no noise will be produced when being carried in the field. The hollow housing has an opening therein for permitting the removal of the shotgun cartridges from the hollow housing. First access means are provided for permitting access to a predetermined number of the shot gun cartridges so that a force can be applied thereto to overcome the force being applied by at least a portion of the resilient means so that the predetermined number of shotgun cartridges may be removed. At least another portion of the resilient means prevents movement of the remaining shotgun cartridges in the hollow housing. Second access means are provided for permitting access to the remaining shotgun cartridges so that a force can be applied thereto to move them to a new location at which all or a portion of the remaining shotgun cartridges may be removed. The hollow housing is provided with a pair of opposite guide channels dimensional to receive the flange portion of each shotgun cartridge so that the hollow housing may be used to hold shotgun cartridges having different lengths. The shotgun cartridges are inserted into the hollow housing so that the flange of the first shotgun cartridge is located in one of the opposite guide channels and the next shotgun cartridge is reversed so that its flange is located in the other of the opposite guide channels. This process is repeated until the hollow housing is full. The hollow housing comprises a front wall portion having two spaced apart front sections and at least one front bridging section extending between and integral with the front sections, a top wall portion having two spaced apart top sections, a back wall portion having two spaced apart back sections and at least one back bridging section extending between and integral with the back sections, a bottom wall portion comprising an opening for removing said shotgun cartridges when in the hollow housing and two opposite sidewall portions spaced apart a predetermined distance.

In one preferred embodiment of the invention, the resilient means comprise first resilient means located adjacent to the opening and second resilient means located adjacent to the front bridging section. The first resilient means comprise at least one slot formed in each of the two front sections to form two resilient fingers and at least one boss formed on each of the two resilient fingers and extends inwardly into the hollow housing and located adjacent to the opening. A pair of spaced apart slots are formed in the at least one back bridging section and at least one boss is formed thereon and extends inwardly into the hollow housing and is located adjacent to the opening. The second resilient means comprise a portion of the front bridging section that is spaced from each of the two front sections and has at least two spaced apart portions extending inwardly into the hollow housing. In this embodiment of the invention, half of the shotgun cartridges are removed in one action and the other half remains to be subsequently removed.

In another preferred embodiment of the invention, the resilient means comprise a first resilient means, the same as the above-described first resilient means, a second resilient means, the same as the above-described second resilient means, and a third resilient means located adjacent to the upper portion of the front bridging means and spaced from the front sections and having spaced apart portions extending inwardly into the housing. I this embodiment of the invention, two shotgun cartridges are removed at a time.

Attachment means are provided and have a base portion extending between and integral with the back sections and a resilient finger extending from the base portion in a direction toward the bottom. This permits the hollow housing to be secured to a belt. Also a wall mount is provided for mounting the hollow housing when not in field use.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
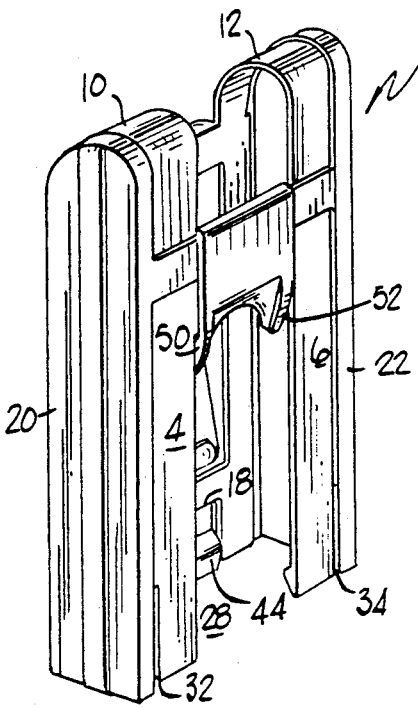
FIG. 1 is a perspective view from the front of one preferred embodiment of this invention.
Figure 2:
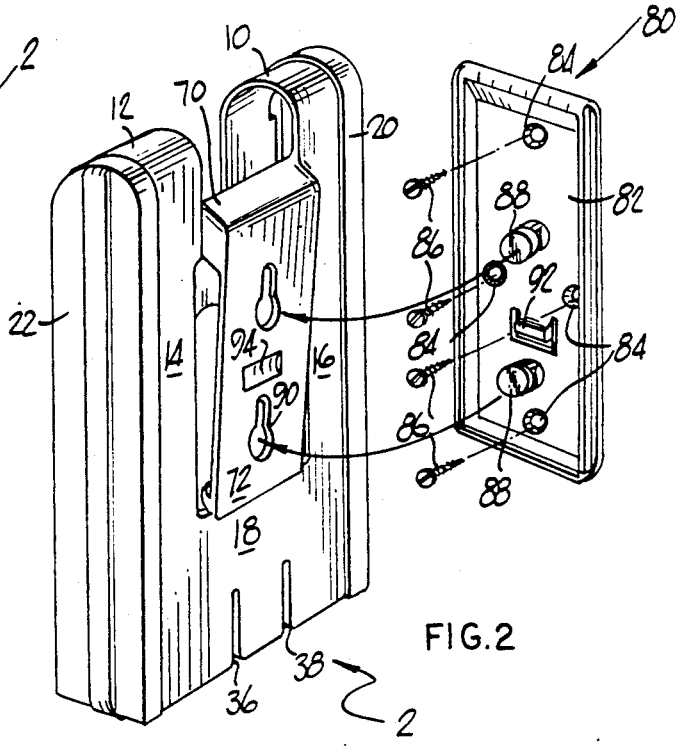
FIG. 2 is a perspective view from the back of FIG. 1 and from the front of a wall mount.
Figure 3:
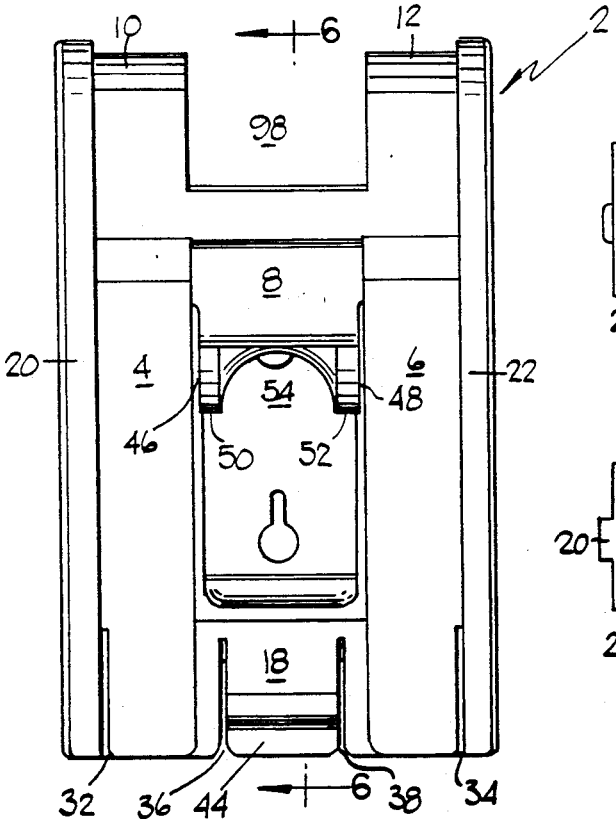
FIG. 3 is a front elevational view of FIG. 1.
Figure 4:
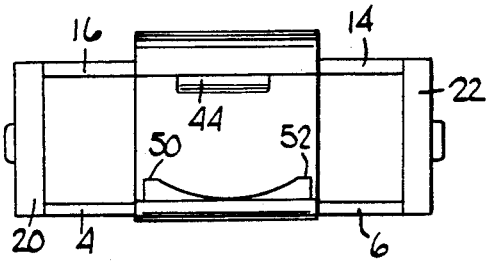
FIG. 4 is a top plan view of FIG. 3.

In FIGS. 1-6, there is illustrated one preferred embodiment of a device of this invention. A hollow housing 2 has a front wall portion comprising two spaced apart front sections 4 and 6 and a front bridging section 8 extending between and integral with the front sections 4 and 6. The hollow housing 2 has a top wall portion comprising two spaced apart top sections 10 and 12. The hollow housing 2 has a back wall portion comprising two spaced apart back sections 14 and 16 and a back bridging section 18 extending between and integral with the back sections 14 and 16. The hollow housing 2 has two sidewall portions 20 and 22 integral with the front sections 4 and 6, the top sections 10 and 12 and the back sections 14 and 16. The sidewall portions 20 and 22 have channels 24 and 26 formed therein for purposes described below. The hollow housing 2 has a bottom wall portion comprising an opening 28 for permitting the removal of shotgun cartridges 30.

Figure 6:
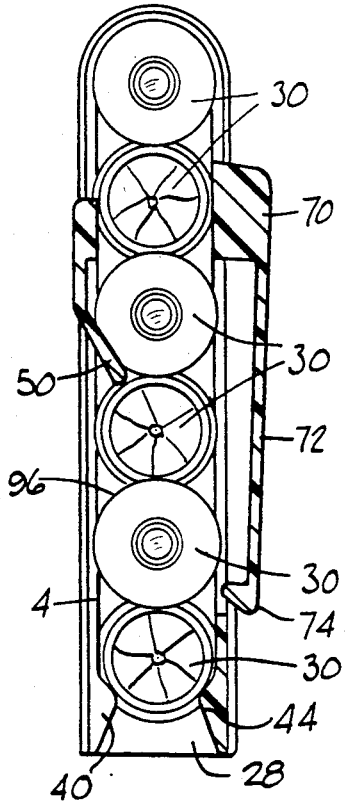
FIG. 6 is a cross-sectional view taken on the line 6—6 of FIG. 3.
Figure 7:
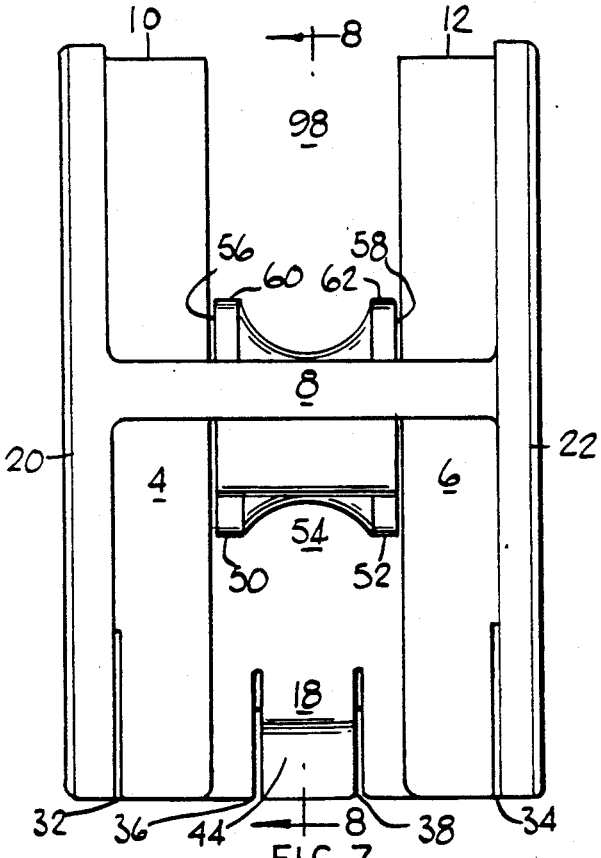
FIG. 7 is a front elevational view of another preferred embodiment of the invention.
Figure 8:
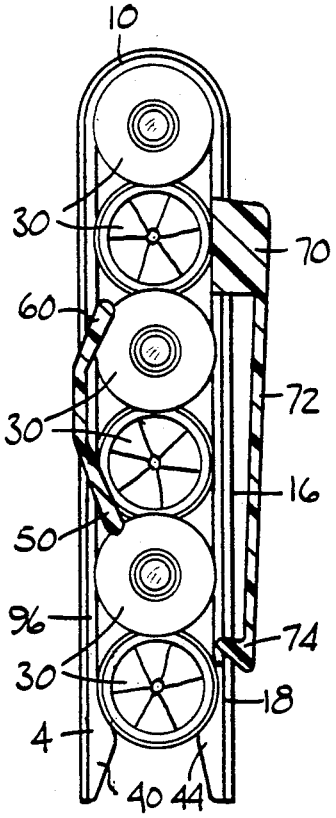
FIG. 8 is a cross-sectional view taken on the line 8—8 of FIG. 7.

Resilient means are provided for releasably securing the shotgun cartridges 30 in the hollow housing 2. First resilient means comprise slots 32 and 34 cut out in the front sections 4 and 6 to form two resilient fingers and slots 36 and 38 cut out in the back bridging section 18 to form a resilient finger. The inner surfaces of the front sections 4 and 6 are provided with inwardly extending bosses 40 and 42 and the inner surface of the back bridging section 18 has an inwardly extending boss 44. In FIGS. 1-6, second resilient means comprise slots 46 and 48 cut out in the front bridging section 8 to provide two spaced apart inwardly extending portions 50 and 52. The front bridging section 8 has a semi-circular recess 54 cut out so that a thumb or finger can be inserted to remove shotgun cartridges 30. In FIGS. 7 and 8, third resilient means comprise slots 56 and 58 cut out in the front bridging section 8 to provide two spaced apart inwardly extending portions 60 and 62. The front bridging section 8 in FIGS. 7 and 8 is slightly different from the front bridging section in FIGS. 1-6 for purposes described below.

Attachment means are provided and comprise a base section 70 extending between and integral with the back portions 14 and 16 and a downwardly extending resilient finger 72 having an inwardly extending boss 74 so that the hollow housing 2 may be positioned on a belt (not shown).

A wall mount 80 is provided and comprises a base portion 82 having openings 84 formed therein so that it may be secured to a wall (not shown) by the screws 86. The base portion 82 has two outwardly extending lugs 88 to cooperate with two openings 90 in the resilient finger 72 for mounting the hollow housing 2 on the base portion 82. Resilient means 92 and 94 on the base portion 82 and the resilient finger 72 cooperate in holding the hollow housing 2 on the base portion 82.

Figure 5:
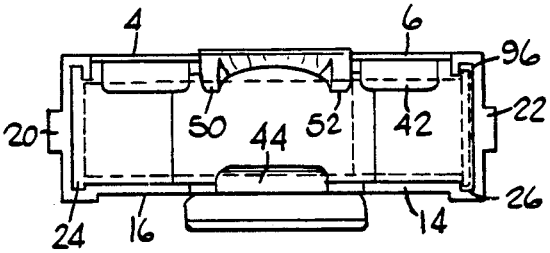
FIG. 5 is a bottom plan view of FIG. 3.

In operation, the flange portion 96, FIG. 5, of a shotgun cartridge 30 is placed in one of the two channels 24 and 26 and moved past the first resilient means into the hollow housing 2. The flange portion 96 of another shotgun cartridge 30 is placed in the other one of the two channels 24 and 26 and moved past the first resilient means into the hollow housing and moving the first shotgun cartridge further into the housing. Four additional shotgun cartridges 30 are moved into the hollow housing 2 and the first three shotgun cartridges are moved in succession past the second resilient means. As illustrated in FIG. 6, movement of the lower three shotgun cartridges 30 is prevented by the bosses 40, 42 and 44 and the inwardly extending portions 50 and 52 and movement of the upper three shotgun cartridges 30 is prevented by the inwardly extending portions 50 and 52 and the inner surfaces of the top sections 10 and 12. When shotgun cartridges 30 are needed, a thumb is inserted through the opening 54 to apply a downwardly directed force on the shotgun cartridge 30 closest to the opening 54 to remove three shotgun cartridges 30. After the three shotgun cartridges 30 have been loaded, a force is applied to the top shotgun cartridge 30 in the access opening 98 between the top sections 10 and 12 to move three shotgun cartridges 30 to a location between the bosses 40, 42 and 44 and the inwardly extending portions 50 and 52 to hold the shotgun cartridges 30 from moving.

In the hollow housing 2 of FIGS. 7 and 8, the inwardly extending portions 50 and 52 are at a location that is slightly lower than that of FIGS. 1-6 so that two shotgun cartridges 30 are removed at a time. In FIG. 8, movement of the two lower shotgun cartridges 30 is prevented by the bosses 40, 42 and 44 and the inwardly extending portions 50 and 52 and movement of the upper four shotgun cartridges 30 is prevented by the inwardly extending portions 50, 56, 60 and 62 and the inner surfaces of the top sections 10 and 12. After two shotgun cartridges 30 have been removed, the remaining four shotgun cartridges 30 are moved downwardly by the application of force through the access opening 98. Movement of the lower two shotgun cartridges is prevented by the bosses 40, 42 and 44 and the inwardly extending portions 50 and 52 and movement of the upper two shotgun cartridges 30 is prevented by the inwardly extending portions 50, 52, 60 and 62.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A device for holding a plurality of articles and having means for permitting removal of at least one of the articles comprising:

a hollow housing for holding a plurality of articles and formed from a relatively rigid material;

resilient means for preventing movement of said articles when in said hollow housing;

said hollow housing having an opening therein for permitting the removal of said articles when in said hollow housing;

said hollow housing having first access means to permit access to a predetermined number of said articles when in said hollow housing to apply a force thereto to overcome at least a portion of said resilient means and remove said predetermined number of said articles from said hollow housing; and at least another portion of said resilient means preventing movement of the articles remaining in said hollow housing until it is desired to remove another of said predetermined number of said articles.

2. The invention as in claim 1 and further comprising:

said hollow housing having second access means to permit access to said remaining articles when in said hollow housing to apply a force to said remaining articles to overcome said another portion of said resilient means and move said remaining articles toward said opening.

3. The invention as in claim 2 wherein:

said resilient means preventing movement of said remaining articles in said hollow housing.

4. The invention as in claim 3 wherein:

said articles comprise firearm cartridges having at least one outwardly extending flange portion thereon.

5. The invention as in claim 4 and further comprising:

guide means in said housing to receive said flange portions to guide said movement of said firearm cartridges in said housing.

6. The invention as in claim 3 wherein said resilient means comprise:

first resilient means located adjacent to said opening; and second resilient means located adjacent to said first access means.

7. The invention as in claim 3 wherein said resilient means comprises:

first resilient means located adjacent to said opening;

second resilient means located adjacent to said first access means; and third resilient means located between said first and second access means.

8. The invention as in claim 1 and further comprising:

attachment means on said housing for permitting attachment of said housing at a relatively fixed location.

9. The invention as in claim 1 wherein said housing comprises:

a front wall portion, a top wall portion, a back wall portion and two opposite sidewall portions.

10. The invention as in claim 9 wherein:

said front wall portion having two spaced apart front sections and at least one front bridging section extending between and joining portions of said two front spaced apart sections;

said top wall portion having two spaced apart top sections; and said back wall portion having two spaced apart back sections and at least one back bridging section extending between and joining portions of said two back spaced apart sections.

11. The invention as in claim 10 wherein:

said first access means are located between said front bridging means and said opening.

12. The invention as in claim 11 and further comprising:

said hollow housing having second access means to permit access to said remaining articles when in said hollow housing to apply a force to said remaining articles to overcome said another portion of said resilient means and move said remaining articles toward said opening.

13. The invention as in claim 12 wherein:

said second access means are located between said two spaced apart top sections; and said resilient means preventing movement of said remaining articles in said hollow housing.

14. The invention as in claim 13 wherein said resilient means comprise:

first resilient means located adjacent to said opening; and second resilient means located adjacent to said first access means.

15. The invention as in claim 14 wherein:

said first resilient means comprise at least one slot formed in one of said two front sections to form a resilient finger and at least one boss formed on a portion of said resilient finger and extending inwardly into said hollow housing and located adjacent to said opening; and said second resilient means comprise a portion of said front bridging section that is spaced from each of said two front sections and has at least one portion thereof extending inwardly into said housing.

16. The invention as in claim 14 wherein:

said first resilient means comprise at least one slot formed in each of said two front sections to form two resilient fingers and at least one boss formed on each of said two resilient fingers and extending inwardly into said hollow housing and located adjacent to said opening; and said second resilient means comprise a portion of said front bridging section that is spaced from each of said two front sections and has at least two spaced apart portions extending inwardly into said hollow housing.

17. The invention as in claim 13 wherein said resilient means comprises:

first resilient means located adjacent to said opening;

second resilient means located adjacent to said first access means; and third resilient means located between said first and second access means.

18. The invention as in claim 17 wherein:

said first resilient means comprise at least one slot formed in one of said two front sections to form a resilient finger and at least one boss formed on a portion of said resilient finger and extending inwardly into said hollow housing and located adjacent to said opening;

said second resilient means comprise a portion of said front bridging section that is spaced from each of said two front sections and has at least one portion thereof extending inwardly into said housing; and said third resilient means comprise another portion of said front bridging section that is space from said one portion of said front bridging section and that is spaced from each of said two front sections and has at least one portion thereof extending inwardly into said housing.

19. The invention as in claim 17 wherein:

said first resilient means comprise at least one slot formed in each of said two front sections to form two resilient fingers and at least one boss formed on each of said two resilient fingers and extending inwardly into said hollow housing and located adjacent to said opening;

said second resilient means comprise a portion of said front bridging section that is spaced from each of said two front sections and has at least two spaced apart portions extending inwardly into said hollow housing; and said third resilient means comprise another portion of said front bridging section that is spaced from said one portion of said front bridging section and that is spaced from each of said two front sections and has at least two spaced apart portions extending inwardly into said hollow housing.

20. A device for holding a plurality of firearm cartridges and having means for permitting removal of the firearm cartridges comprising:

a hollow housing for holding a plurality of firearm cartridges and formed from a relatively rigid material;

said hollow housing comprising a front wall portion having two spaced apart front sections and at least one front bridging section extending between and joining said front sections, a top wall portion having two spaced apart top sections, a back wall portion having two spaced apart back sections and at least one back bridging section extending between and joining said back sections, a bottom wall portion comprising an opening for removing said firearm cartridges when in said hollow housing and two opposite sidewall portions spaced apart a predetermined distance;

resilient means for preventing movement of said firearm cartridges when in said hollow housing;

said hollow housing having first access means to permit access to a predetermined number of firearm cartridges when in said hollow housing to apply a force thereto to overcome at least a portion of said resilient means and remove said predetermined number of firearm cartridges from said hollow housing;

at least another portion of said resilient means preventing the movement of the remaining firearm cartridges when in said hollow housing;

said hollow housing having second access means to permit access to said remaining firearm cartridges to apply a force to said remaining firearm cartridges to overcome said another portion of said resilient means to move said remaining firearm cartridges toward said opening;

each of said firearm cartridges having at least one outwardly extending flange portion;

guide means in said hollow housing for guiding the movement of said firearm cartridges when in said hollow housing and said guide means comprising a guide channel adjacent each of said opposite sidewall portions and being dimensioned to receive said flange portion s that firearm cartridges having a length shorter than said predetermined distance may be retained in said hollow housing.

* * * * *